US009157275B2

(12) United States Patent
Leng

(10) Patent No.: US 9,157,275 B2
(45) Date of Patent: Oct. 13, 2015

(54) LADDER AND A LADDER TREAD

(75) Inventor: Luhao Leng, Fujian (CN)

(73) Assignee: NEW-TEC INTEGRATION (XIAMEN) CO., LTD., Xiamen (CN)

( * ) Notice: Subject to any disclaimer, the term of this patent is extended or adjusted under 35 U.S.C. 154(b) by 486 days.

(21) Appl. No.: 12/602,659

(22) PCT Filed: Jun. 25, 2008

(86) PCT No.: PCT/CN2008/071431

§ 371 (c)(1),
(2), (4) Date: Dec. 2, 2009

(87) PCT Pub. No.: WO2009/003393

PCT Pub. Date: Jan. 8, 2009

(65) Prior Publication Data

US 2010/0170750 A1 Jul. 8, 2010

(30) Foreign Application Priority Data

Jun. 29, 2007 (CN) ..... 2007 2 0007518 U

(51) Int. Cl.
*E06C 7/10* (2006.01)
*E06C 7/08* (2006.01)
*E06C 1/393* (2006.01)

(52) U.S. Cl.
CPC ..... *E06C 7/083* (2013.01); *E06C 1/393* (2013.01); *E06C 7/084* (2013.01)

(58) Field of Classification Search
CPC ..... E06C 7/083
USPC ..... 182/288.1–228.4, 228.6, 180.1, 165
See application file for complete search history.

(56) References Cited

U.S. PATENT DOCUMENTS

| | | | | | |
|---|---|---|---|---|---|
| 1,460,680 | A | * | 7/1923 | Peters | 182/228.1 |
| 1,593,783 | A | * | 7/1926 | Stresau | 280/796 |
| 1,960,863 | A | * | 5/1934 | Boyer | 248/238 |
| 2,585,150 | A | * | 2/1952 | McGill | 182/120 |
| 2,594,561 | A | * | 4/1952 | Huck | 182/228.6 |
| 2,899,011 | A | * | 8/1959 | Babits | 182/228.3 |
| 2,989,141 | A | * | 6/1961 | Howard | 182/216 |
| 3,042,140 | A | * | 7/1962 | Basile et al. | 182/46 |
| 3,104,889 | A | * | 9/1963 | Branch, Jr. | 280/30 |
| 3,349,870 | A | * | 10/1967 | Lieblein | 182/228.6 |
| 3,381,775 | A | * | 5/1968 | Livers | 182/228.2 |

(Continued)

FOREIGN PATENT DOCUMENTS

| | | |
|---|---|---|
| CN | 2619038 Y | 6/2004 |
| CN | 2698951 Y | 5/2005 |

(Continued)

OTHER PUBLICATIONS

Modern Language Association (MLA): "wrapping." Dictionary.com Unabridged. Random House, Inc. Jan. 14, 2013. <Dictionary.com http://dictionary.reference.com/browse/wrapping>.*

(Continued)

*Primary Examiner* — Katherine Mitchell
*Assistant Examiner* — Candace L Bradford
(74) *Attorney, Agent, or Firm* — Rabin & Berdo, P.C.

(57) ABSTRACT

A ladder includes legs (10, 20) and a tread (50). The ladder tread (50) is mounted between two legs (10, 20) and includes a plastic step (52) and a metal support bar (51). The plastic step (52) is supported and connected by the metal support bar (51).

7 Claims, 4 Drawing Sheets

(56) References Cited

U.S. PATENT DOCUMENTS

| | | | | | |
|---|---|---|---|---|---|
| 4,009,762 | A | * | 3/1977 | Bjerkgard | 182/20 |
| 4,060,150 | A | * | 11/1977 | Hughes | 182/151 |
| 4,759,162 | A | * | 7/1988 | Wyse | 52/126.6 |
| 5,002,153 | A | * | 3/1991 | Yuen | 182/228.3 |
| 5,031,723 | A | * | 7/1991 | Hooten | 182/129 |
| 5,337,857 | A | * | 8/1994 | Spalt et al. | 182/122 |
| 5,547,041 | A | * | 8/1996 | Morral Gispert | 182/228.4 |
| 5,779,208 | A | * | 7/1998 | McGraw | 248/238 |
| 7,051,837 | B1 | | 5/2006 | Brahier | |
| 2001/0017233 | A1 | * | 8/2001 | Panzeri | 182/228.6 |
| 2004/0231920 | A1 | * | 11/2004 | Meeker | 182/165 |
| 2007/0125602 | A1 | * | 6/2007 | Marbach | 182/228.1 |
| 2008/0202391 | A1 | * | 8/2008 | Pisano | 108/57.25 |

FOREIGN PATENT DOCUMENTS

| | | | | | |
|---|---|---|---|---|---|
| CN | 201056976 | Y | | 5/2008 | |
| EP | 140984 | A1 | * | 5/1985 | E04G 7/22 |
| EP | 1607570 | A2 | | 12/2005 | |
| GB | 2185775 | A | * | 7/1987 | E06C 7/08 |
| GB | 2318607 | A | | 4/1998 | |
| GB | 2318607 | A | * | 4/1998 | E06C 7/16 |
| JP | 2001073660 | A | | 3/2001 | |

OTHER PUBLICATIONS

Modern Language Association (MLA): "ellipse." Dictionary.com Unabridged. Random House, Inc. Sep. 7, 2013. <Dictionary.com http://dictionary.reference.com/browse/ellipse>.*

(Definition of oval adjective from the Cambridge Academic Content Dictionary © Cambridge University Press).*

* cited by examiner

LADDER AND A LADDER TREAD

FIELD OF THE INVENTION

The present invention relates to ladders, more specifically, the present invention relates to ladder rungs.

BACKGROUND OF THE INVENTION

Conventional ladder rung has to satisfy two requirements of enough support strength and large enough area of surface. So far there are two kind of ladder rungs, one of which is ladder rung of aluminum alloy, the other one of which is ladder rung of plastic. However, they both have shortages, for example because the ladder rung is made of aluminum alloy, the cost of it is too high; because the ladder rung is made of plastic, the plastic ladder rung is difficult to connected to legs of the ladder.

SUMMARY OF THE INVENTION

The present invention provides a ladder and a ladder rung for the ladder, which overcomes the disadvantages of high manufacturing cost and difficult connection.

A technical solution provided by the present invention is:

A ladder rung of a ladder having two front legs, the ladder rung comprising a metal support bar having a rectangular shape, the metal support bar forming a joint with each of the two front legs; a plastic tread comprising a longitudinal body having two ends and a bottom, the bottom having a fixing through groove substantially in the middle and along the longitudinal body, the fixing through groove having an indented shape corresponding to the rectangular shape of the metal support bar, each of the two ends extending outwards, upwards and downwards to form a decoration cover, the decoration cover covering the joint.

Another technical solution provided by the present invention is:

A ladder comprising two front legs; a ladder rung between the two front legs, the ladder rung comprising: a metal support bar having a rectangular shape, the metal support bar forming a joint with each of the two front legs; a plastic tread comprising a longitudinal body having two ends and a bottom, the bottom having a fixing through groove substantially in the middle and along the longitudinal body, the fixing through groove having an indented shape corresponding to the rectangular shape of the metal support bar, each of the two ends extending outwards, upwards and downwards to form a decoration cover, the decoration cover covering the joint.

In a preferred embodiment of the present invention, the ladder further comprises an iron strengthening plate, wherein the metal support bar joints the iron strengthening plate, and wherein the iron strengthening plate is covered by the decoration cover.

In a preferred embodiment of the present invention, the metal support bar is welded to the iron strengthening plate.

In a preferred embodiment of the present invention, the iron strengthening plate joins the front legs through rivets.

In a preferred embodiment of the present invention, the two front legs have an elliptical shape.

In a preferred embodiment of the present invention, each of the two front legs has two grooves on the major axis of the elliptical shape.

In a preferred embodiment of the present invention, the iron strengthening plate comprise two engaging edges for engaging the grooves.

In a preferred embodiment of the present invention, the iron strengthening plate comprise two engaging edges for engaging two grooves in each of the two front legs.

In a preferred embodiment of the present invention, an interior shape of the decoration cover matches an exterior shape of the iron strengthening plates.

In the ladder rung of the present invention, the plastic tread is supported and connected by the metal support bar, so the ladder rung not only satisfies the two requirements of sufficient support strength and surface area, but also has the following advantages: 1 the manufacturing cost is reduced; 2. owing to the connection between the metal support bar and the front legs, it is easy for the ladder rung to be connected to the legs and the connection strength is high. The metal is not directly fixed to the front legs but fixed to the front legs through the strengthening plates, so the present invention also has the following advantages: 1. The strengthening could disperse the pressure to metal support bar in order to protect and strengthen the legs; 2. Compared to conventional designs, the combination of the ladder rung and the front legs is more secure and more artistic. The iron strengthening plates cover part of the front legs and are fixed to them. The decoration cover covers the iron strengthening plates to provide a clean surface of the ladder according to the present invention.

Figure 1:
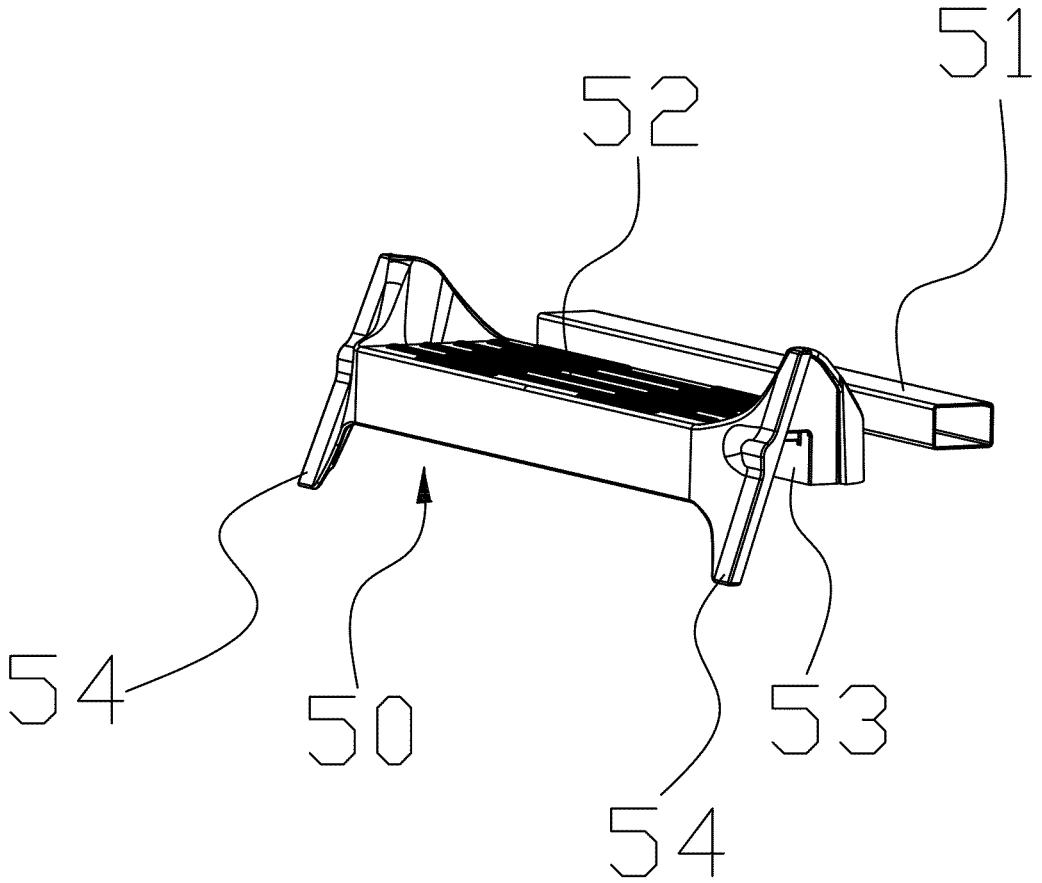
FIG. 1 is an exploded perspective view of a ladder rung in a preferred embodiment of the present invention.
Figure 2:
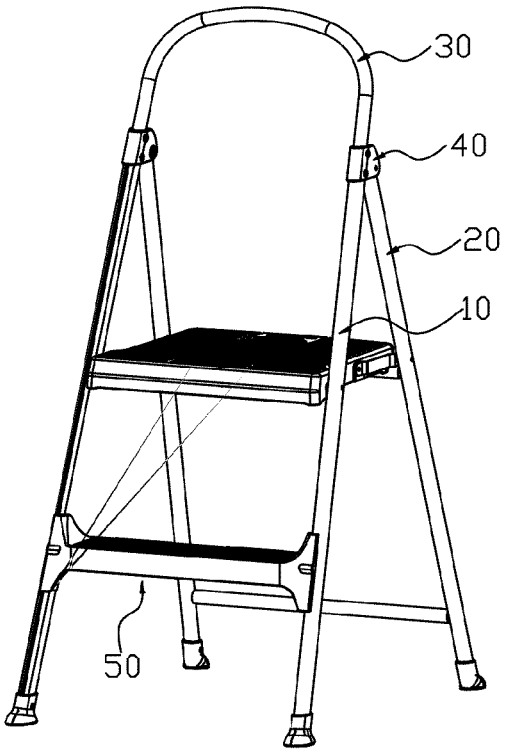
FIG. 2 is a perspective view of the ladder in a preferred embodiment of the present invention.

DESCRIPTION OF MARKS IN THE DRAWINGS front legs - - - 10; rear legs - - - 20; handrail - - - 30; hinges - - - 40; ladder rung - - - 50; groove - - - 11; iron strengthening plates - - - 12; stuck edges - - - 121; metal support bar - - - 51; plastic tread - - - 52; fixing through groove - - - 53; decoration cover - - - 54.

DESCRIPTION OF SPECIFIC EMBODIMENTS

In a preferred embodiment of the present invention, referring to FIG. 1, the ladder rung 50 comprises a plastic tread 52 and a metal support bar 51. The bottom of the plastic tread 52 includes a fixing through groove 53. Furthermore, both ends of the plastic tread 52 extend outwards, upwards and downwards to form a decoration cover 54. The decoration cover 54 is perpendicular to the body of the plastic tread 52. The metal support bar 51 is fittingly fixed to the fixing through groove 53. The length of the metal support bar 51 is matches or exceeds slightly the length of the fixing through groove 53. In the illustrated embodiment, the cross section of the metal support bar 51 has a rectangular shape, matching the rectangular shape of the fixing through groove 53, to ensure that they do not rotate relative to each other.

Figure 3:
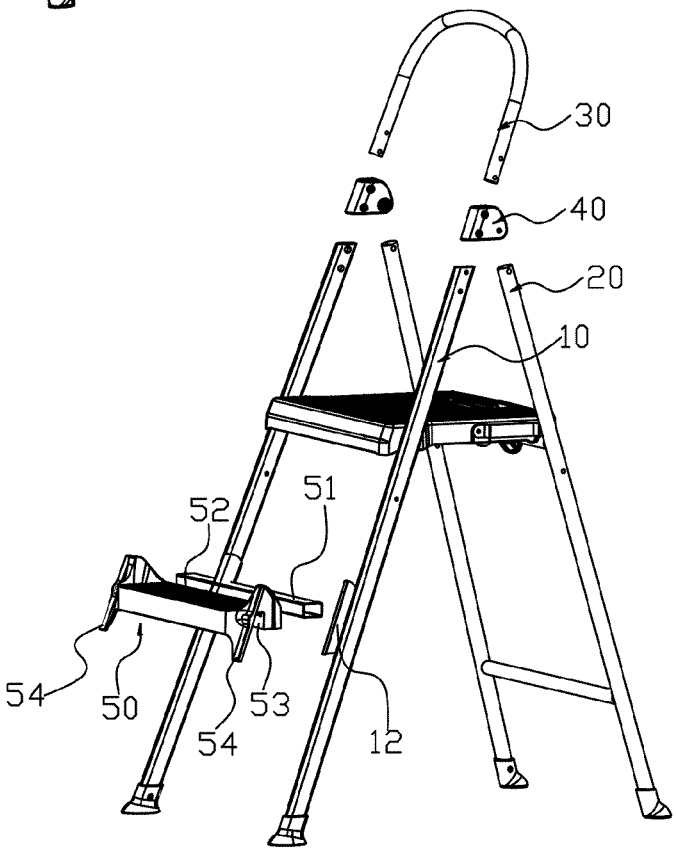
FIG. 3 is an exploded perspective view of the ladder in a preferred embodiment of the present invention.
Figure 4:
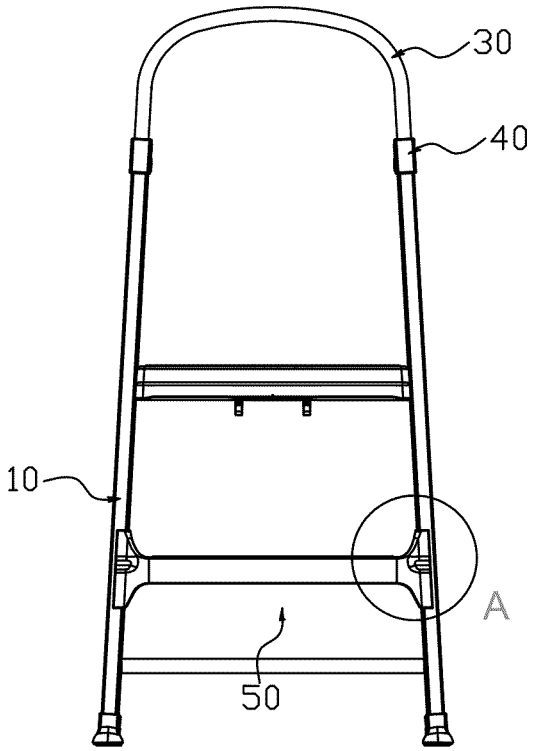
FIG. 4 is a front view of the ladder in a preferred embodiment of the present invention.

In another preferred embodiment of the present invention, referring to FIGS. 1, 3 and 4, the ladder comprises two front legs 10, two rear legs 20, a handrail 30, a set of hinges 40 and a ladder rung 50. In the preferred embodiment, the front legs

10, the rear legs 20 and the handrail 30 are made from aluminum alloy. The ladder rung 50 is fixed between the two front legs 10. The handrail 30 and the front legs 10 are fixed together with the set of hinges 40. The rear legs 20 are rotatable connected to the set of hinges 40 in order to achieve the hinge connection between the front legs 10 and the rear legs 20.

Figure 5:
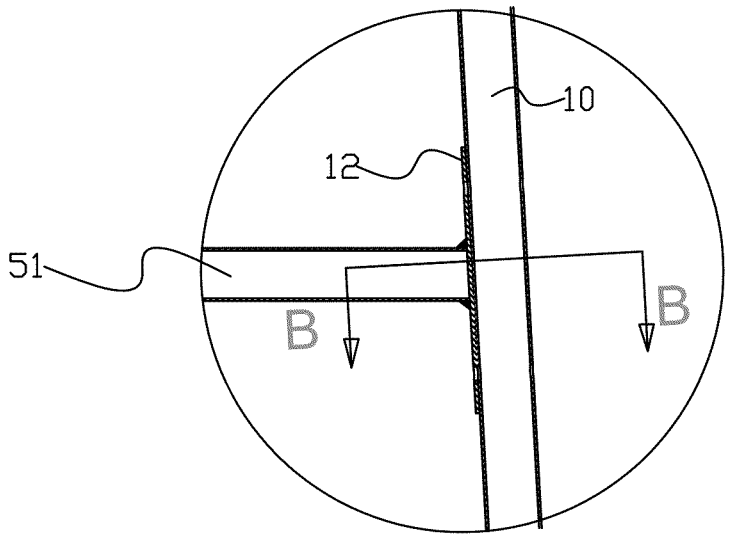
FIG. 5 is a sectional view of the part A in FIG. 4.
Figure 6:
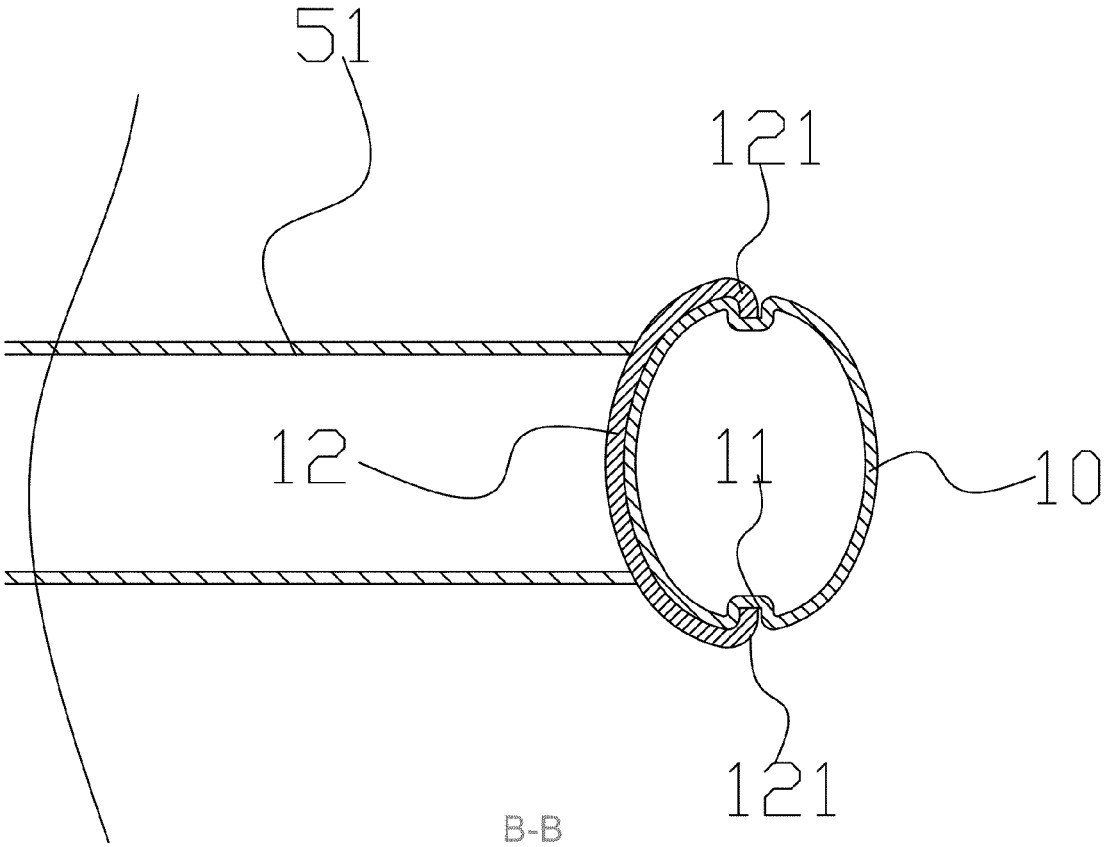
FIG. 6 is a cross-sectional view of the B-B line in FIG. 5.
Figure 7:
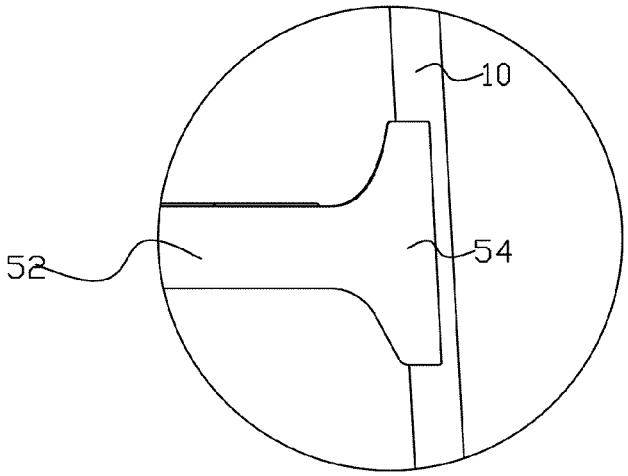
FIG. 7 is an enlarged view of part A in FIG. 4.

Referring to FIGS. 5-7, the cross-section of the front legs 10 has an elliptical shape. In the illustrated embodiment, two grooves are laid on the major axis of the elliptical shaped front leg 10. An iron strengthening plate 12 is provided. The two ends of the iron strengthening plate 12 are made into engaging edges 121. The engaging edges 121 engage the two grooves 11, respectively. Each end of the iron strengthening plate 12 is joined to the front leg 10 with rivets, surrounding the inner surface of the front leg 10.

The ladder rung 50 comprises a plastic tread 52, a metal support bar 51. The bottom of the plastic tread 52 includes a fixing through groove 53. Furthermore, both ends of the plastic tread 52 extend outwards, upwards and downwards to form a decoration cover 54. The metal support bar 51 is engaged in the fixing through groove 53, and the length of the metal support bar 51 is matches or exceeds slightly the length of the fixing through groove 53 in order to prevent the ends getting into the fixing through groove 53. The metal support bar 51 may have a rectangular shape, matching the rectangular shape of the fixing through groove 53, to ensure that they do not rotate relative to each other.

The metal support bar 51 is joined, for example, welded to the iron strengthening plate 12. The interior shape of the decoration part 54 of the plastic tread 52 matches the exterior shape of the iron strengthening plates 12 so that the decoration part 54 covers the iron strengthening plate 12 engaging the front legs 10. As a result, the iron strengthening plates 12 could be decorated and the plastic tread could be stabilized, which make the ladder more secure and more artistic.

INDUSTRIAL APPLICABILITY

In the present invention, the ladder rung comprises a metal support bar and a plastic tread, which has the advantages of rational design, superior security, convenience of manufacturing.

What is claimed is:

1. A ladder rung of a ladder having two oval shaped front legs, each of the two oval shaped front legs having a front longitudinal groove and a rear longitudinal groove therealong, the ladder rung comprising:

a metal support bar having a rectangular cross-section;

an iron strengthening plate having a front engaging edge and a rear engaging edge, the iron strengthening plate enclosing a surface between the front longitudinal groove and the rear longitudinal groove of the front legs, the front engaging edge terminating at and engaging the front longitudinal groove and the rear engaging edge terminating at and engaging the rear longitudinal groove, the front longitudinal groove and the rear longitudinal groove located on an exterior surface and along a major axis of the oval shaped front legs; and a plastic tread comprising a longitudinal body having two ends and a bottom, the bottom having a fixing through groove substantially in the middle and along the longitudinal body, the fixing through groove having an indented shape corresponding to the rectangular cross-section of the metal support bar, each of the two ends extending outwards, upwards and downwards forming a decoration cover perpendicular to the longitudinal body, the decoration cover covering the entire iron strengthening plate.

2. The ladder rung according to claim 1, wherein the metal support bar is welded to the iron strengthening plate.

3. The ladder rung according to claim 1, wherein the iron strengthening plate join the front legs through rivets.

4. A ladder comprising:

two oval shaped front legs, each of the two oval shaped front legs having a front longitudinal groove and a rear longitudinal groove therealong; and a ladder rung between the two front legs, the ladder rung comprising:

a metal support bar having a rectangular cross-section;

an iron strengthening plate having a front engaging edge and a rear engaging edge, the iron strengthening plate enclosing a surface between the front longitudinal groove and the rear longitudinal groove of the front legs, the front engaging edge terminating at and engaging the front longitudinal groove and the rear engaging edge terminating at and engaging the rear longitudinal groove, the front longitudinal groove and the rear longitudinal groove located on an exterior surface and along a major axis of the oval shaped front legs; and a plastic tread comprising a longitudinal body having two ends and a bottom, the bottom having a fixing through groove substantially in the middle and along the longitudinal body, the fixing through groove having an indented shape corresponding to the rectangular cross-section of the metal support bar, each of the two ends extending outwards, upwards and downwards forming a decoration cover perpendicular to the longitudinal body, the decoration cover covering the entire iron strengthening plate.

5. The ladder according to claim 4, wherein the metal support bar is welded to the iron strengthening plate.

6. The ladder according to claim 4, wherein the iron strengthening plate joins the front legs through rivets.

7. The ladder according to claim 4, wherein an interior shape of the decoration cover matches an exterior shape of the iron strengthening plates.

* * * * *